US007409071B1

(12) United States Patent
Bromer

(10) Patent No.: US 7,409,071 B1
(45) Date of Patent: Aug. 5, 2008

(54) LARGE-DIAMETER ARCUATE SPEAKER

(76) Inventor: Nick Bromer, 402 Stackstown Rd., Marietta, PA (US) 17547-9311

( * ) Notice: Subject to any disclaimer, the term of this patent is extended or adjusted under 35 U.S.C. 154(b) by 921 days.

(21) Appl. No.: 10/619,294

(22) Filed: Jul. 15, 2003

Related U.S. Application Data

(60) Provisional application No. 60/401,320, filed on Aug. 7, 2002, provisional application No. 60/395,603, filed on Jul. 12, 2002.

(51) Int. Cl.
*H04R 5/00* (2006.01)

(52) U.S. Cl. ..... 381/335; 381/186; 381/430; 381/339; 381/396

(58) Field of Classification Search ..... 181/182, 181/179, 153, 163, 165, 189, 195; 381/339, 381/186, 395, 430, 396, 308, 335, 336, 89
See application file for complete search history.

(56) References Cited

U.S. PATENT DOCUMENTS 2,602,860 A 7/1952 Doubt
3,931,867 A * 1/1976 Janszen ..... 181/155
4,837,826 A * 6/1989 Schupbach ..... 381/308
5,227,591 A * 7/1993 Tarkkonen ..... 181/145
5,973,999 A 10/1999 Naff et al.
6,625,289 B1 * 9/2003 Oliemuller ..... 381/182
6,801,631 B1 * 10/2004 North ..... 381/336
7,088,830 B2 * 8/2006 Norris et al. ..... 381/77

OTHER PUBLICATIONS

Sketch by Applicant.

* cited by examiner

*Primary Examiner*—Wayne Young
*Assistant Examiner*—Dionne Pendleton

(57) ABSTRACT

In an arcuate array of speakers (100) the wind component of air motion near each speaker is converted into sound because the wind is trapped within the arc, and therefore the bass response is improved. The array acts like a single large speaker, of diameter equal to the array diameter, when radiating bass sounds. A central baffle (10) also directs the wind and contributes to converting wind into sound. A semi-circular arc can be used along with a symmetry baffle (500) that further directs the wind, so that the number of speakers required is reduced. The symmetry baffle can be the floor, on which rests a cabinet (1) embodying the arcuate array.

11 Claims, 3 Drawing Sheets

FIG. 2
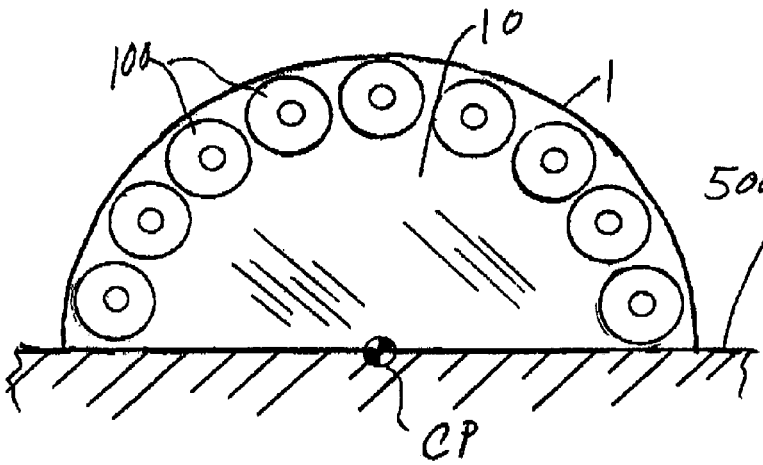
FIG 3
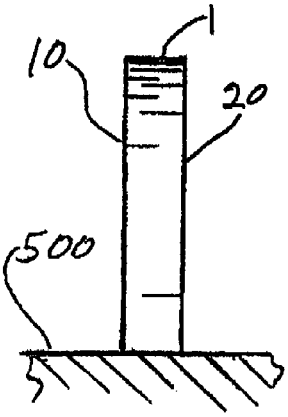
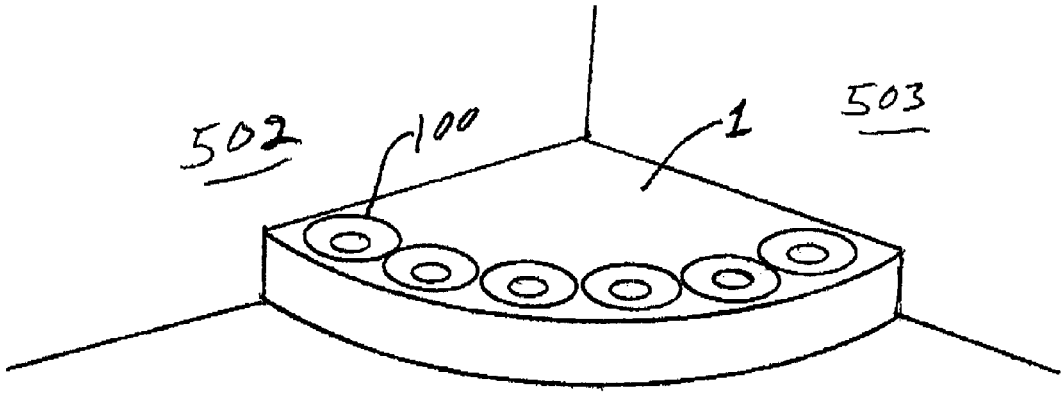
FIG. 4
500

LARGE-DIAMETER ARCUATE SPEAKER

CROSS REFERENCE TO RELATED APPLICATIONS

The Applicant claims benefit of his provisional application 60/395,603 filed Jul. 12, 2002 and entitled "Large-Diameter Speaker Array" and his provisional application 60/401,320 filed Aug. 7, 2002, entitled "Large-Diameter Speaker Array With Symmetry Baffle." The contents of these earlier applications are entirely incorporated herein by reference.

FIELD OF THE INVENTION

This invention relates to loudspeakers, especially to woofers.

BACKGROUND OF THE INVENTION

Consider a small, sinusoidally-pulsating hemisphere on an infinite surface or baffle. It pushes on the air at its surface, causing the adjacent air to move along with the surface, and causing sound to radiate. This hemisphere is the approximate, but accurate, model of the cone of a loudspeaker mounted in a sheet of plywood that is driven with a sound signal. The back-and-forth motion of the air has a direction and a speed that is called "particle velocity" because it is the velocity of a small particle, like a dust mote, suspended in the air and moving with it. ("Particle velocity" is not to be confused with the "wave velocity" of sound, which is about 1100 feet per second, very much greater than the particle velocity.) The particle velocity is in the radial direction, in and out from the center of the hemisphere.

The pulsating motion also produces changes in the air pressure, and the particle velocity can be divided into two parts that differ in their relationship to the air pressure. I call these parts sound, and wind. The total particle motion of the air near the speaker surface is the sum of the sound motion and the wind motion, just as your velocity while walking in a moving train is the sum of the train velocity and your walking velocity. In the sound part of the air motion, the pressure and the particle velocity are in phase, and energy is carried away as sound; in the wind part, the pressure is 90° out of phase with the particle velocity and no energy is carried away (and therefore you can't hear it). Another way of saying this is that when the particle velocity is at all out of phase with the pressure, there is wind as well as sound; and when it is 90° out of phase, there is no sound, only wind. The wind is also referred to a "mass loading" because it results in a mass of air pulsating in and out, that affects the speaker like a weight glued to the speaker cone.

From physics I derived that the sound component of the particle velocity is proportional to $1/r$, where r is the radius from the center of the pulsating hemisphere, but the wind component is proportional to $1/r^2k$, where k is the "wave number" of the sound having the same frequency as the frequency of vibration of the hemisphere (or speaker cone). The quantity k is defined as $2\pi/\lambda$, where $\lambda$ is the wavelength of the sound. Both r and k should be in the same units (e.g., r in feet and k in 1/feet, r in meters and k in 1/meters, etc.).

An example: at 30 Hz, the wavelength of sound is 36.6 feet and therefore the wave number is 0.17 $ft^{-1}$. At that frequency, a 12-inch woofer (approximating a theoretical pulsating hemisphere of radius 0.5 ft) produces sound proportional to 2 (i.e., proportional to $1/r$) and wind proportional to 23.5 (i.e., proportional to $1/r^2k$) right next to the speaker (i.e., at a distance of 0.5 feet). The total air motion is 23.6, which is calculated as the square root of $[(2)^2+(23.5)^2]$. The two particle velocity components are added "vectorially" this way due to the 90° phase difference, not because of the direction of particle speed is different for the sound and wind; as noted, all the particle motion is in the radial direction, in or out from the center of the hemisphere.

The proportion of air motion that is sound, which I call the "radiating efficiency," is then 2/23.6 or 0.085 (8.5%). Clearly, when a 12-inch speaker tries to radiate sound at 30 Hz, most of the speaker cone's action is wasted. Because of this inefficiency, a woofer cone must move through a very large displacement, and it creates a good deal of wind, so much so that light objects in front of the speaker cone can be seen to vibrate. But this motion of the air is almost all inaudible. This example illustrates the general rule of physics, that objects much smaller than a wavelength are not good wave radiators.

If the speaker were made larger, then the radius r and the radiating efficiency would increase. For example, if the speaker radius were 5.8 feet instead of 0.5 feet, then the radiating efficiency would be 50% at the same 30-Hz frequency (i.e. air motion of half wind and half sound), instead of 8.5%. But such a large speaker cone is entirely impractical, not only because of its size but because the sound quality deteriorates as speaker cone size increases. Due to decreased stiffness with increasing size, the cone flaps and oscillates instead of moving as a whole, and that causes sound distortion.

But a single large speaker can be approximated with an array of small speakers. If a large plane area were solidly tiled with speakers all moving in phase, then the radiating efficiency for low frequency would be good because the solid tiling is a close approximation to a single large vibrating area. But for this to work, the speakers must be close together. If there were no neighboring speakers, the wind would fall away as $1/r^2$ with the distance r from the center of the speaker. However, the other speakers prevent the wind from flowing outward, because the winds from neighboring speakers collide.

I studied this by way of the flux of wind passing through a cylindrical surface, of radius R, concentric with the speaker. I determined that the flux through this cylindrical surface is proportional to $1/R$. In an array of hexagonally-spaced speakers (set along lines at 120°) the air pushed by each speaker is confined to a hexagonal cell, which is very close to a cylinder. Because of the neighboring speakers, then, virtually all the wind will be confined inside the cylinder (when it collides with the wind from neighboring speakers) and so the flow of piled-up air away from the baffle will be proportional to what would have gone out of the cylinder, i.e. the flux. Therefore, doubling the spacing between speaker centers will roughly halve the wind perpendicular to the baffle surface and therefore halve the radiating efficiency.

That speakers in an area array should be close for improved bass response was discovered experimentally by Doubt and described in his U.S. Pat. No. 2,602,860. Experimenting with various arrays of speakers, Doubt found no improvement in bass response over that of isolated speakers when the speakers were separated by one diameter, and found the most improvement when the speakers were set very close.

Doubt found that a larger array has a better bass response, and stated in his patent that doubling the size of the array improved the bass response by one octave. However, Doubt had no theoretical understanding, had no idea of how to group the speakers, and related the bass radiating efficiency to the number of speakers instead of to the diameter of the array.

SUMMARY OF THE INVENTION

Since an array acts like a single large speaker, and the bass radiation is related to the radius through the $1/r^2k$ term, the radius is the controlling geometrical factor and an array of speakers should approximate a circle in outline to achieve a good bass response. My invention includes arranging a plurality of speakers to maximize the radius (or diameter) of the array of speakers, in order to maximize the bass response. In a square array (which was advocated by Doubt), the corners are, I believe, of very little use for the bass response, and their wind is wasted in the sense that it is not converted to sound.

Thus, a solid tiling of speakers should have a generally circular outline for maximum radiating efficiency (wind-to-sound ratio); it should be a disk array. Round speakers can be put into solid-tiling hexagonal arrays numbering 1, 3, 7, 19, 37, 61, . . . speakers, with the speakers preferably being very close. These hexagonal arrays are nearly circular in outline.

The area of such a disk array increases as the square of the diameter, and therefore so do the weight, and the expense. The gain in wind-sound efficiency is proportional to that weight and expense, because both go as the square of the disk radius. However, it would be better if the expense and weight could be minimized while still retaining the size advantage.

Therefore, my first preferred embodiment is a hollow ring of speakers set into a plane baffle (e.g., the side of a speaker cabinet), with no speakers in the interior (or, only auxiliary speakers such as tweeters, sub-rings, etc.). Through the calculations mentioned above, and through symmetry arguments, I decided that at low frequencies a circular hollow ring of close-set speakers would have a radiating efficiency nearly as good as the radiating efficiency of a close-set disk array (or single large speaker) of the same diameter, as long as the total displacement of air is the same. (The total displacement is figured like the displacement of an engine, sum of bore times stroke, i.e., total speaker cone area times axial cone displacement). That is, I expected that a hollow ring of small speakers should radiate bass sound as well as a single large speaker with a diameter equal to the outer ring diameter, if that large speaker moved the same amount of air (to do this it would have a smaller stroke than any of the small speakers).

The reason I expected this is that air is essentially incompressible at the very low pressures involved in sound. When the speakers are set in a baffle, the inward-directed wind is trapped. It can only move perpendicular to the baffle as a whole, and therefore it produces no net wind flux through an imaginary cylindrical surface around the speaker ring array and perpendicular to the baffle in which the speakers are set.

A ring of speakers without a central baffle, that is, a ring of speakers in space, should have about one-half of the bass radiating efficiency of the same ring with the central baffle, because the wind could escape in two directions, and would not pile up and be converted to sound. A ring without a central baffle is within the invention, though not preferred. One example would be a ring of speakers each facing their opposite number across the circle, that is, with their axes all directed to a central point. Tilting of the speakers in the array, at any angle, is within the invention.

For radiating efficiency at bass frequencies, the diameter of the speakers should not matter, only the diameter of the ring. The ring array has the advantage that the speakers constituting the ring can be small, which makes them not only less expensive by the square inch of radiating source, but also of higher fidelity. A ring of four-inch diameter speakers will have the same crisp sound as a single speaker of that size, because of its light-weight, stiff cone.

My second preferred embodiment is a partial, rather than a full, ring of speakers. This embodiment uses a surface, such a floor, as a second baffle and reduces the number of speakers needed. This embodiment is based on symmetry. In a full ring the winds from the various speaker collide, as discussed above, and therefore the air at the center point of the array should be still at the surface of the baffle: only the pressure should rise and fall with the sound-cycles. But the same is true on a radial line passing from the center point between any two speakers; there should be no motion of the air across such a line along the surface. And this holds true above the baffle surface: there should be no motion of the air across a plane rising from the radial line perpendicular to the surface.

As an example, if a sheet of paper is held above the surface of the central baffle, perpendicular to that surface and along a line bisecting the ring of speakers, then it should not be buffeted by the wind from the speakers (or by the sound either). The forces on the paper, from the speakers on either side, are balanced.

Thus, the production of sound from a ring does not involve any motion across a bisecting plane like that of the paper sheet. Therefore, if the paper is replaced with something heavy, like a sheet of plywood, and the speakers on one side of plywood are disconnected, the remaining half ring should keep radiating efficiently at a low frequency, because the air motion at the sheet of plywood is unchanged and the plywood is heavy enough to resist the buffeting caused by the half-ring of speakers. The sound volume will be decreased in volume because the number of speakers is decreased, but the bass radiating efficiency is not.

In view of the discussion above, a first preferred embodiment is a half-ring resting on the floor or a wall, which takes the place of the plywood sheet in the example above. A third preferred embodiment is an arc of a quarter-circle fitted into a corner.

My invention is most easily embodied in distinct loudspeakers deployed in a generally circular arc, but any ring-shaped or annular or arcuate source of wind is within the scope of the invention. The wind can be produced by any means of producing a pulsating or varying wind or flow, and the preferred embodiment of a pulsating or vibrating surface or surfaces is only exemplary.

BRIEF DESCRIPTION OF THE DRAWING FIGURES

FIG. 2 is an elevational view of a first variation on a second preferred embodiment of the invention.

FIG. 3 is an side view the embodiment of FIG. 2.

FIG. 4 is a perspective view of a second variation on the second preferred embodiment of the invention.

FIG. 6 is a schematic view of a tilted speaker.

DETAILED DESCRIPTION OF THE PREFERRED EMBODIMENT

Figure 1:
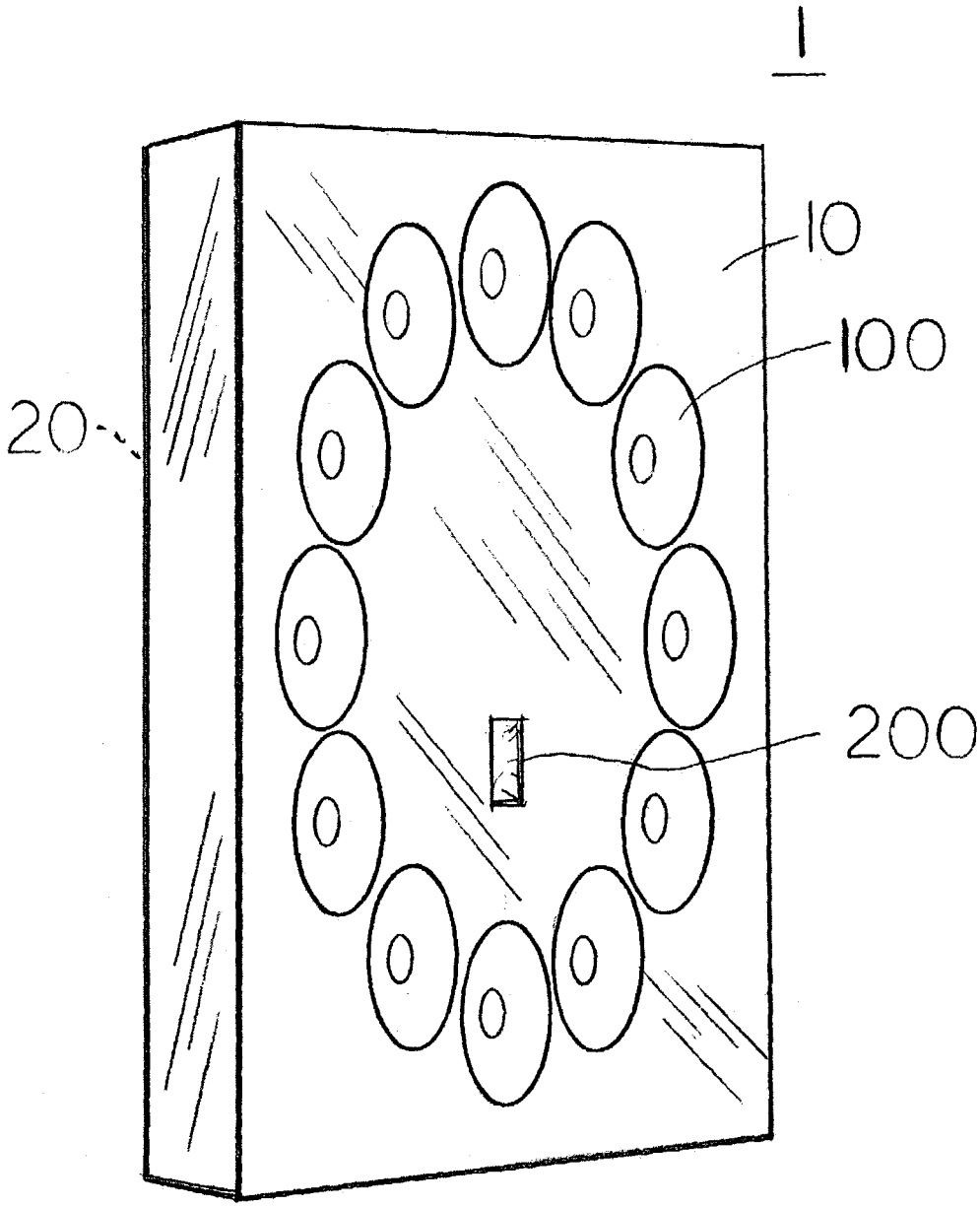
FIG. 1A is a perspective view of a first preferred embodiment of the invention.
Figure 5:
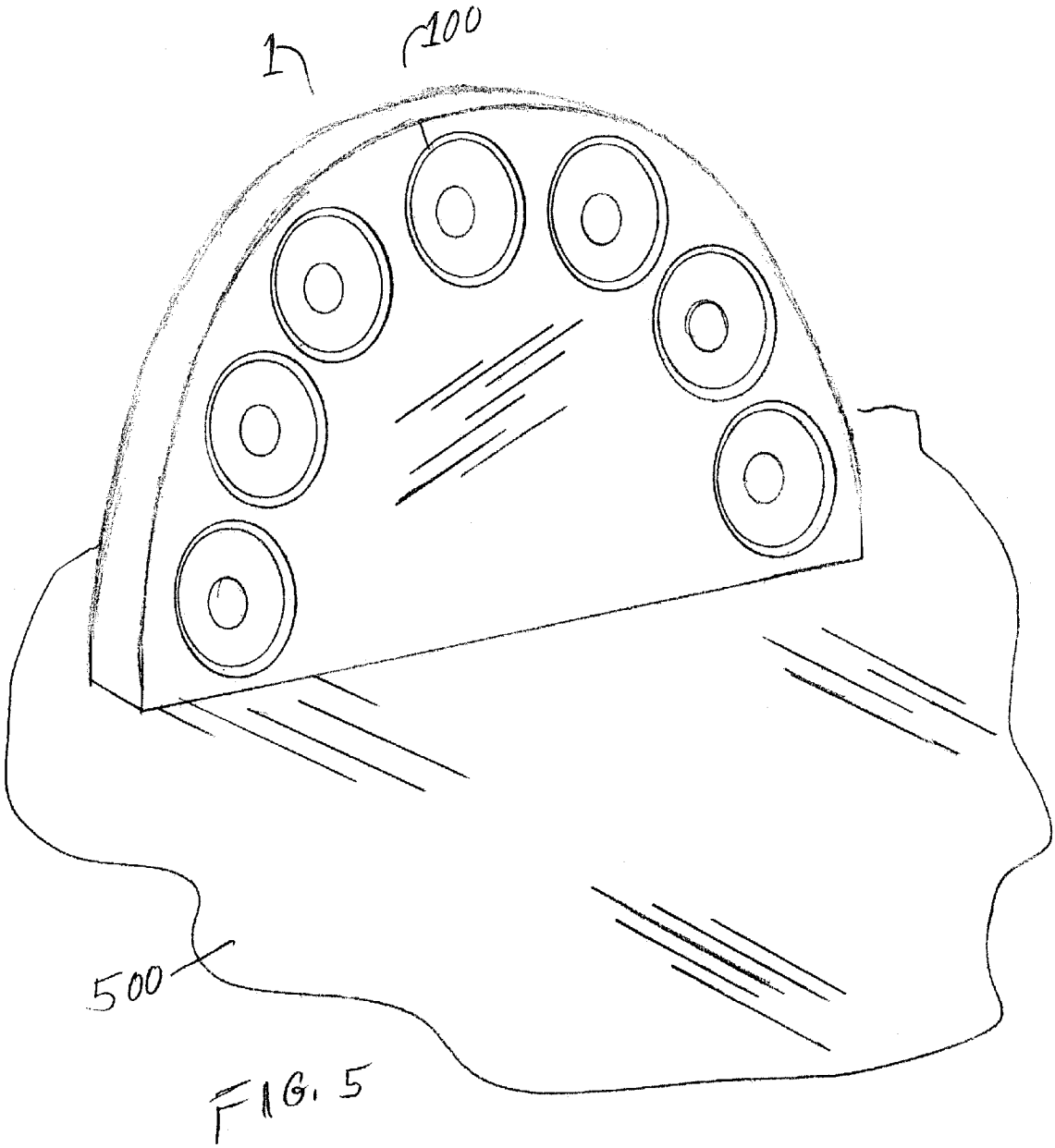
FIG. 5 is a perpective view.

FIG. 1 shows a speaker cabinet 1, which can be of conventional construction. It might be made of plywood, for example. On a front side panel 10 is a ring of ordinary electrodynamic speakers 100, which are preferably mounted in holes in the front panel. The cabinet is preferably not thicker than it needs to be to accommodate the depth of the speakers, and the back sides (magnets) of the speakers can even be glued to the rear panel 20 if desired. Other than the ring of speakers 100, there may be conventional auxiliary speakers or speaker, such as the illustrated tweeter 200. Other auxiliary speakers, such as an air speaker, a subsidiary ring of electrodynamic speakers, or a line array are among the possible auxiliary speaker(s). The wiring is not shown, but is discussed below.

The speakers 100 are preferably not too large, so that the sound in the midrange is not distorted. The preferred size is four to eight inches, but other sizes can be used. Although any one of the speakers alone would have a poor bass response, the ring array of speakers has a strong bass response due to the physics discussed above. If the array includes, for example, 12 six-and-one-half-inch-diameter speakers close-set in a semicircle, then the ring has an effective (outer) radius of roughly 30 inches. Therefore, it will act like a single 60-inch diameter speaker as to radiating efficiency. Both highs and lows are reproduced clearly and cleanly.

The array is about nine times as big in diameter as any single speaker in the array. Therefore, according to the law of Doubt discussed above, the bass "cut-off" should drop more than three octaves (three octaves corresponds to an eight-times increase in diameter, which is three doublings). If the output from the single speaker starts to drop off at 100 Hz, then the output from the arcuate array will start to drop of at around 12.5 Hz. (The "cut-off" is arbitrary because the radiating efficiency does not fall off abruptly, and it must be defined, as an arbitrary proportion relative to some higher frequency at which the radiating efficiency is high and the sound wavelength is not bigger than the speaker diameter.)

Any desired radiating efficiency at any chosen bass frequency can be achieved by adjusting the size of the array. Thus, there is no need for resonance with my array, and no need for ports in the speaker cabinet. Therefore, the speaker cabinet does not need to be bulky nor does it need any convoluted internal passages. The cabinet for my array can typically be slightly thicker than the speakers themselves, or about four inches thick.

As a first example, I built a speaker cabinet including on a front face a circular ring of eight 6½ inch speakers, deployed with their edges touching and mounted on the outside of the front face of the cabinet. The cabinet measured 24 inches square by 3 and ¼ inches thick, with the speakers inscribed in a circle of 23½ inches diameter. This speaker array had a substantial base response. The impedance of the array was 8 ohms.

Although the circular or ring-shaped array uses only a fraction of the number of speakers that would be needed for a full disk, the number can be reduced by using a baffle. FIG. 2 shows a semi-circular cabinet 1 that rests on a floor 500, and FIG. 3 shows a side view of the same embodiment. In the front panel 10 of the cabinet 1 is mounted the half-ring of speakers 100. The panel 10 is an example of a central baffle. (The same numbers are used for similar elements throughout the drawing.) The half-ring of speakers 100 wind describes an arc from a single center point CP, shown in FIG. 2.

The floor 500 acts as a symmetry baffle for the illustrated half-ring array, as long as the speaker-bearing face 10 of the cabinet 1 is generally at right angles to the floor 500. The theory is explained above, I call the floor surface a "symmetry plane" (or "symmetry baffle") and the intersection between the cabinet 1 and the floor 50 the "symmetry line". As compared to the embodiment of FIG. 1, the number of speaker is reduced to one-half, reducing the cost and expense substantially; but the bass radiating efficiency is not changed.

My invention includes not only a cabinet resting on a floor (or mounted to a wall or ceiling), but also a cabinet with a built-in symmetry baffle. One example is a fold-down cover (not shown) hinged along the symmetry line. The embodiment of FIGS. 2-3 can also be mounted up against a wall, instead of placed on a floor. If the floor is the symmetry baffle and the cabinet rests on the floor, then the surface of the cabinet that rests on the floor I call a "mount."

As an example of the second embodiment, I built a semi-circular cabinet with a semi-circular array of twelve 6½ inch speakers. The speaker cabinet had a thickness of four and ¼ inches and a radius of 29½ inches, with the speakers inscribed within a circle of 28½ inches on the front panel, so that the radius of the central area between the speakers was 22 inches and the central area was larger in diameter than the speaker diameter. The twelve speakers, each of four ohms' impedance, were wired in three parallel gangs each comprising four speakers in series, so that the total impedance was 5.3 ohms. A two-rack-unit thick power amplifier was built into the middle portion of the cabinet, with a hole to access the amplifier controls. This speaker combo had a full bass response. The floor served as a symmetry baffle, the combo being held in position by gravity on the bottom mounting surface.

A third embodiment is shown in FIG. 4. In this embodiment there are two symmetry planes or baffles 502, 504, which preferably are two walls at the corner of a room; the floor 500 is not a symmetry baffle in this case (although it may increase radiating efficiency by preventing backflow of wind). This embodiment is especially adapted to use a subwoofer and/or pedestal for home theater equipment, or to be placed at the ceiling in a corner of a room. The principle is the same as explained above: a second symmetry plane can bisect the half-ring of FIG. 2 and the winds from the two sides balance. In this embodiment, only one-fourth as many speakers are needed as with the full ring shown in FIG. 1, while maintaining the same bass response. Just as the second embodiment is "half" of the first embodiment, the embodiment of FIG. 4 is "half" of the second embodiment.

As the embodiments described above show, the arc of the radius r can include a 1/n fraction of a whole circle, where n is a positive integer. For example, the FIG. 1 embodiment exemplifies that n=1, that of FIG. 2 that n=2, and that of FIG. 4 that n=4.

FIG. 6 illustrates the tilt of a speaker 100 relative to the plane P of a central baffle.

The impedance of the array can be made different from the impedance of the individual speakers. The first example discussed above, with a full ring of eight speakers, used eight 4-ohm speakers in two gangs, and had an array impedance of eight ohms. The impedance of the array can be made to equal the impedance of the individual speakers by choosing the number of speakers equal to a perfect square $n^2$ of a number n ($n^2$=4, 9, 16, 25, 36, 49, . . . ). The speakers are divided into n gangs each containing n speaker wired in series; then all of the gangs are wired in parallel. This makes the array have the same impedance as the individual speakers. Of course, speakers of different impedances can also be used in one arcuate array.

Because of the many speakers used in the ring, the power rating of each speaker can be small. The array will tolerate a power input equal to the rated wattage of each speaker times the number of speakers.

One advantage of my invention is that the "footprint" is small for amount of wattage. Also, the cabinet is thin so it can be placed next to the wall, out of the way, while in use or for storage. The cabinet preferably uses thin sheet material and internal braces and/or struts which (can include the speakers themselves). The two sheets of tensile material, with braces between, provide a stressed-skin structure that is light but strong.

Although the large-diameter array provides a good bass response without the need for ports, resonators, very large speakers, and other typical bass response enhancers, these can be used with the large-diameter array of my invention. Adjusting the air volume inside a sealed cabinet in order to increase the speakers' excursion at lower frequencies, through internal resonance, is one possibility. Preferably, the speaker cabinet is sealed.

In my invention, an array of speakers can be defined as having a certain bass response, defined in some way such as for example by at least 10% sound, in relation to a certain array radius. Another possible criterion is a 50-50 split between sound and wind motion. Under that criterion, an array radius of 5.8 feet would be defined to have a bass response to 30 Hz.

The preferred high, thin cabinets of my invention could include supports for stability, such a bolt-on L-shaped brackets having lower extended ends resting on the floor. The cabinet can also have wheels.

The decorative appearance of the cabinets and/or the speaker arrays shown in the drawing are part of my invention.

One embodiment that is not pictured, but which has a ornamental appearance that will be clear to the reader, is a round cabinet with a full circle of speakers. Such a cabinet could be rolled, which might be useful in larger sizes.

At present my preferred arrangement is to set the individual speakers as close as possible within the arc. However, it seems possible that the bass response might not suffer if the spacing were increased. If close-set speakers are moved radially outward then the ring diameter increases, while the speaker diameter stayed the same. The wind from each speaker might be expected to fall off as 1/C, where C is the radius of an imaginary cylinder centered on the speaker and touching the imaginary cylinders of the adjoining speakers. The quantity C will increase directly with the radius R of the arc, but the bass response of the ring should increase as $R^2$ while falling off as 1/C. Therefore, the bass response might not suffer.

One embodiment that is not illustrated is a double ring of speakers; either a double ring for different frequency ranges (e.g., a second ring of tweeters) or alternating large and small speakers deployed in a single ring. In the latter, larger speakers such as 12-inch woofers could be used to make the ring large, while smaller speakers such as 4-inch midrange speakers could be set to fill gaps between the woofers. My invention includes an arc composed of speakers of different shapes (round, oval, square, etc.).

My invention can be used under water. The only difference is that the speed of sound is different, and therefore the related quantities, such as the wave number, are also different.

Besides a movable cabinet, my invention includes arrays of speakers or speaker cabinets. In a theater, for example, a ring of individual speaker cabinets could be mounted on the ceiling for use as a subwoofer. An arcuate speaker array can also be mounted into a wall or floor, without a separate cabinet, according to my invention.

The embodiments described above all use electrodynamic loudspeakers as the components of an arcuate array. However, any arcuate source of wind is within the scope of my invention, in particular, an arcuate air valve, and more especially an arcuate air valve (wind flux gate) in which wind is directed radially inward toward the center, or sucked outward from the center of a central baffle.

The preferred embodiments described above all deploy speakers in arcs of a circle. However, while a circle is believed to be the optimum shape, any generally or approximately circular, or rounded, arc or arc segment is within the scope of the invention. Departures from a circular arc may be made for cosmetic reasons, to fit a certain number of speakers onto a certain size of cabinet panel, or for other reasons. Ovals, ellipses, and polygons are only examples of shapes that can be used in the invention. Also, the arcuate line array of the invention includes an arc with superposed variation, such as waviness or zig-zag.

A flat panel, on which the speakers are mounted, is the easiest to make but the panel on which the speakers are mounted can be curved so as to angle the speakers inward. A shallow conical baffle might be advantageous.

The individual speakers can be tilted inward, preferably all at the same angle, which could improve the sound distribution.

In the following claims, "electrodynamic loudspeaker" refers to any transducer that converts electrical signals into sound and/or wind having a waveform following the waveform of the electrical signal in frequency and amplitude; thus, "electrodynamic loudspeaker" excludes a device in which an electrical signal triggers an explosion, because the sonic waveform of the explosion has no relation to the electrical waveform as seen on an oscilloscope, for example. Also in the following claims, "annular diameter" means either an inner or an outer diameter and "mount" includes a surface adapted for resting on a floor.

I claim:

1. A loudspeaker for outputting sound in a frequency range including a lowest frequency f, the lowest frequency f having a wave number k; the loudspeaker comprising:

a generally arcuate source of wind pulsating at the frequency f, the source having an arcuate radius r such that a quantity rk is approximately equal to or larger than one;

wherein r is greater than 1.00 feet;

wherein the generally arcuate source of wind describes an arc of the radius r from a single center point, and further comprising a mount for mounting at least one symmetry baffle aligned substantially perpendicular to a plane including the arcuate source and its radius; and wherein a center point of the arc lies adjacent the symmetry baffle;

whereby wind is converted into sound at the lowest frequency f and bass response is improved.

2. The loudspeaker of claim 1, wherein the generally arcuate source of wind comprises a plurality of electrodynamic loudspeakers disposed in an arcuate line array.

3. The loudspeaker of claim 1, wherein the center point is on a central baffle or at an edge of the central baffle.

4. The loudspeaker of claim 1, wherein the arc of the radius r includes a 1/n fraction of a whole circle, where n is an integer.

5. The loudspeaker of claim 1, comprising a first symmetry baffle and a second symmetry baffle, and wherein the first symmetry baffle and the second symmetry baffle are set at an angle to one another.

6. The loudspeaker of claim 1, comprising a central baffle aligned parallel with a plane defined by the generally arcuate source of wind.

7. The loudspeaker of claim 6, wherein the generally arcuate source of wind comprises a plurality of electrodynamic loudspeakers disposed in at least a portion of a generally arcuate line array, and the loudspeakers are mounted in the surface of the central baffle.

8. The loudspeaker of claim 7, comprising a hollow cabinet in which the loudspeakers are mounted, and wherein the loudspeakers are mounted in holes in the surface of the central baffle.

9. The loudspeaker of claim 7, wherein the speakers are tilted relative to the central baffle.

10. The loudspeaker of claim 9, wherein the speakers are all tilted at a same angle.

11. A method of creating sound of a frequency f, having a wave number k; the method comprising:

providing a generally arcuate source of pulsating wind having an outer arcuate radius r such that a quantity rk is approximately equal to or larger than one; and pulsating the wind at the frequency f, whereby the pulsating wind is converted into sound at the frequency f with a high radiation efficiency;

providing a central baffle aligned with a plane defined by the generally arcuate source of wind; and providing at least one symmetry baffle aligned substantially perpendicular to the central baffle, and wherein the step of providing a generally arcuate source of pulsating wind includes providing the arcuate source around an arc such that it meets the symmetry baffle generally perpendicularly at two points;

wherein r is greater than 1.00 feet.

* * * * *